US006195057B1

(12) United States Patent
Kornblith et al.

(10) Patent No.: US 6,195,057 B1
(45) Date of Patent: Feb. 27, 2001

(54) SUBMARINE ANTENNA ASSEMBLY FOR DEPLOYMENT THROUGH ICE LAYER

(75) Inventors: Jeffrey S. Kornblith, Holly Springs, NC (US); James E. Eninger, Torrance, CA (US); James M. Zamel, Hermosa Beach, CA (US); Samuel Kuo Kan, Rancho Palos Verdes, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/378,114

(22) Filed: Aug. 20, 1999

(51) Int. Cl.[7] ..... H01A 1/34

(52) U.S. Cl. ..... 343/709; 343/710; 175/18; 441/3

(58) Field of Search ..... 343/704, 709, 343/710; 175/11, 14, 17, 18; 342/385, 386; 248/168, 169, 170, 171; 299/14, 24; 441/3, 11, 30; H01Q 1/34

(56) References Cited

U.S. PATENT DOCUMENTS 4,699,222 * 10/1987 Taylor ..... 175/18
5,116,268 * 5/1992 Eninger et al. ..... 441/3
5,319,376 * 6/1994 Eninger ..... 342/357

* cited by examiner

*Primary Examiner*—Tho Phan
(74) *Attorney, Agent, or Firm*—Michael J. McGowan; Prithvi C. Lall; Michael F. Oglo

(57) ABSTRACT

A submarine antenna assembly comprises a tubular body having a removable end cap, a mast stowable in the body and extendible therefrom and having elements mounted thereon, a penetrator stowable in the body and movable therefrom by the mast upon removal of the end cap, the penetrator being adapted to bore through an ice layer, and an inflatable ring stowable in the body and movable therefrom by the mast upon the removal of the end cap. First and second capsules are in the body for retaining and releasing gas, the first capsule being adapted upon opening thereof to pressurize the body to blow off the end cap to permit movement of the mast, the ring, and penetrator out of body, and the second capsule being adapted to inflate the ring to hold the penetrator in engagement with an undersurface of the ice layer. An electronics assembly is disposed in the body and includes message retention and transmitting means in communication with the mast, and timer means in communication with the capsules. A spool is mounted in the mast and a tether is wound on the spool and is fixed at a first end to the spool and at a second end to the body. A clutch is engageable with the spool to stop rotation of the spool, whereby to stop paying out of the tether from the spool, the clutch means being activated by the penetrator breaking through the layer of ice.

14 Claims, 6 Drawing Sheets

SUBMARINE ANTENNA ASSEMBLY FOR DEPLOYMENT THROUGH ICE LAYER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to submarine radio antenna assemblies and is directed more particularly to an antenna assembly for deployment through an ice layer.

(2) Description of the Prior Art

When operating submerged under ice, a submarine cannot communicate with the outside world. To do so, it is necessary to project an antenna through the ice. There is thus a need for a means of projecting a submarine-based antenna through an ice layer for transmission of signals from the submarine to a satellite, for example, and on to a command post, and to receive signals therefrom.

It is known to provide an ice-penetrating submarine communication buoy which supports a spring steel tubular extendable mast which pushes an ice penetrator and antenna elements up through a tunnel drilled by the penetrator through up to several feet of ice. Upon break-through of the ice layer, the ice penetrator is explosively ejected and the rapidly-extending antenna is stopped at a selected distance, typically about 18 inches, above the surface of the ice. The conventional approach has been to use a spool fixed inside the buoy, with a tether wound on the spool and one end of the tether fixed to the spool and the end of the tether fixed to the top of the mast. A sensor in the buoy monitors the rotation of the spool and sends information to a microprocessor in an electronics compartment of the buoy. The microprocessor determines ice breakthrough by analyzing the change in the rate of spool rotation. The microprocessor commands an electromagnetic clutch to stop the spool rotation, thereby to hold the tether and stop upward movement of the mast. The microprocessor sends another signal to a squib disposed under the penetrator, to explode the squib to eject the penetrator from the mast.

The antenna deployment must be a fixed distance above the ice to provide proper radio transmission properties. It is deemed beneficial to provide for mast stoppage and antenna deployment without the use of squibs, and without the consumption of electrical power or use of micro-processors. Further, the antenna deployment mechanism must be rugged, compact and lightweight. The antenna elements must be locked in position to withstand wind loading while maintaining transmission characteristics.

SUMMARY OF THE INVENTION

It is, therefore, an object of the invention to provide a submarine antenna assembly for use in deployment through ice layers, wherein the assembly is operative to properly position the antenna components and remove the penetrator therefrom without requiring squibs or other explosive devices, and without requiring microprocessors, or other electrical power consuming components, for the proper deployment of the antenna elements.

A further object of the invention is to provide such an assembly as is reliable in operation, compact and lightweight, and rugged in construction.

A still further object is to provide such an assembly wherein the antenna elements, upon deployment, are locked in position to withstand high winds.

With the above and other objects in view, as will hereinafter appear, a feature of the present invention is the provision of a submarine antenna assembly comprising a tubular body having a removable end cap at a first end thereof, a mast stowable in the body and extendible therefrom, the mast having elements pivotally mounted thereon, a penetrator stowable in the body nearer the end cap than the mast and movable out of the body by the extendible mast upon removal of the end cap, the penetrator being adapted to bore through an ice layer, and an inflatable ring stowable in the body proximate the end cap and movable out of the body by the extendible mast upon the removal of the end cap. First and second capsules in the body are proximate the end cap for retaining and releasing gas, the first capsule being adapted upon opening thereof to pressurize the body to blow off the end cap to permit movement of the mast, the ring, and penetrator out of body, and the second capsule being adapted upon opening thereof to inflate the ring to hold the penetrator in engagement with an undersurface of the ice layer. An electronics assembly is disposed in the body and includes message retention and transmitting means in communication with the mast, and timer means in communication with the capsules. A spool is mounted in the mast and adapted for rotation. A tether is wound on the spool and fixed at a first end to the spool and fixed at a second end to the body. A clutch means is engageable with the spool to stop rotation of the spool, whereby to stop paying out of the tether from the spool, the clutch means being activated, by the penetrator breaking through the layer of ice, to engage the spool.

In accordance with a further feature of the invention, the elements mounted on the mast comprise antenna elements and the clutch means is further engageable with the antenna elements to lock the antenna elements in an extended operative attitude.

The above and other features of the invention, including various novel details of construction and combinations of parts, will now be more particularly described with reference to the accompanying drawings and pointed out in the claims. It will be understood that the particular device embodying the invention is shown by way of illustration only and not as limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

DESCRIPTION OF THE PREFERRED EMBODIMENT

Figure 1:
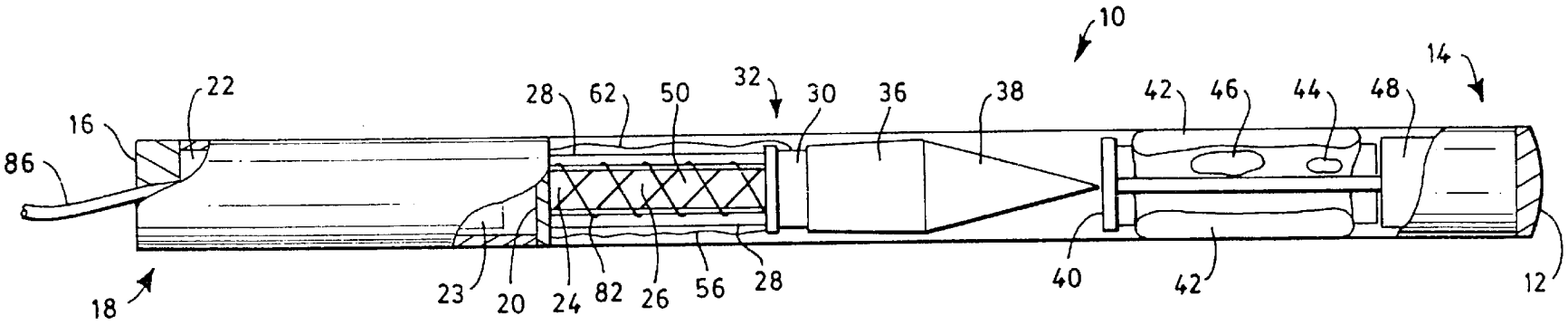
FIG. 1 is a side elevational view, broken away to show internal components of a tubular body housing for the illustrative antenna assembly.
Figure 2:
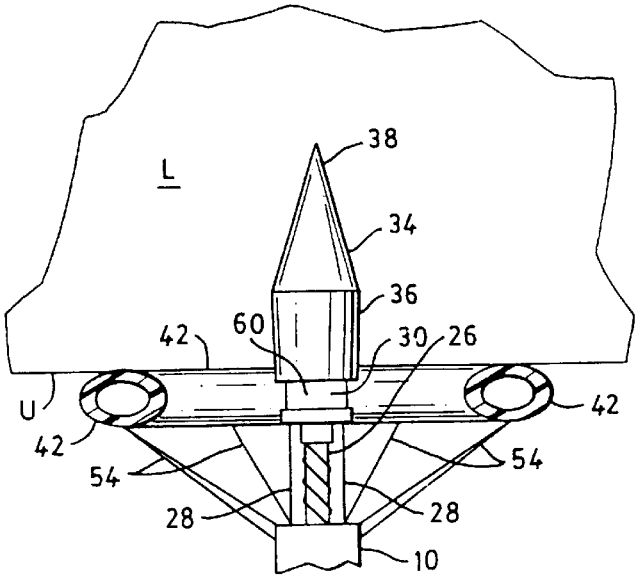
FIG. 2 is a side elevational view of a portion of the assembly entering the underside of an ice layer.

Referring to FIG. 1, it will be seen that an illustrative embodiment of the invention includes a communications buoy in the form of a tubular body 10 having a removable end cap 12 at a first end 14 thereof and a permanent closure 16 at a second end 18 thereof. Between closure 16 and an internal bulkhead 20 there is defined a compartment 22 wherein are disposed electronic components (not shown) of an electronic assembly 23 for the antenna system. Fixed to bulkhead 20 is a base end 24 of an extendible mast 26 on which are pivotally mounted antenna elements 28. In the stored, or non-deployed, condition, antenna elements 28 extend generally alongside mast 26, the antenna elements 28 being confined by the tubular body 10. A mast head portion 30 of mast 26 is fixed to a distal end 32 of mast 26, with the antenna elements 28 pivotally mounted in the mast head portion 30, as will be further described hereinbelow. Mounted on mast head portion 30 is a penetrator 34 as shown in FIG. 2 having a driving portion 36 and a pointed boring portion 38.

Disposed in tubular body 10 adjacent pointed boring portion 38 of penetrator 34 is a cradle 40 (FIG. 1) supporting an inflatable ring 42. Mounted in the tubular body 10 proximate inflatable ring 42 and end cap 12 are first and second capsules 44, 46 for retaining and releasing compressed gas, as, for example, $CO_2$. The capsules 44, 46 are in communication with the electronics compartment 22 and, more particularly, with a timing means portion of the electronics assembly 23 in compartment 22. A body 48 of foam material is disposed between cradle 40 and end cap 12.

While the size of tubular body 10 may vary, so long as it is within the launch capacity of a submarine, a relatively small and lightweight assembly is contemplated. For example, a body 10 of a length of about 39.5 inches and a diameter of about 3 inches has been found satisfactory and is easily accommodated by submarine vertical launch systems.

In operation, tubular body 10 is ejected from a submarine with a message for transmission stored within the electronics compartment 22. The body 10 is buoyant and rises to engage an undersurface U of an ice layer L. At a preset time, the electronics assembly 23 signals the first capsule 44 to open, which pressurizes body 10 and blows off end cap 12.

The mast 26 comprises a metal ribbon 50 coiled around a central post 52. When not confined, or otherwise restrained, metal ribbon 50 uncoils, extending mast 26 axially toward the open end 14 of body 10.

About two seconds after blowing of the end cap 12, the timer means of the electronics assembly 23 activates the second capsule 46 which is in communication with the inflatable ring 42 which will have exited the open end 14 of the body 10. Upon activation of second capsule 46, ring 42 is inflated with body 10 in the annulus of ring 42 and connected to ring 42 by lines 54 (FIG. 2) which support body 10 in position adjacent the underside U of the ice layer L.

The extendible mast 26 extends upwardly until held from further movement by a mast restraint line 56 extending from forward bulkhead 20 of the electronics compartment 22.

In about ten seconds after activation of the second capsule 46, restraint line 56 is cut by a knife edge (not shown), freeing mast 26 for further extension upwardly, carrying therewith the penetrator 34 until the pointed boring portion 38 of penetrator 34 engages underside U of the ice layer L. The metal ribbon coil 50 stores considerable energy and is capable of maintaining penetrator 34 in firm engagement with the ice surface U. At this point, the antenna elements 28 are still held in a generally axial attitude by body 10.

Figure 3:
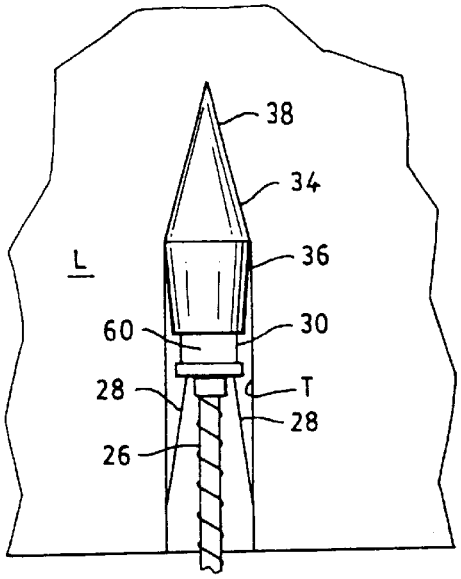
FIG. 3 is similar to FIG. 2, but shows the assembly portion further into the ice layer.

Upon engagement of the penetrator boring portion 38 with the ice underside U, the penetrator driving portion 36 is activated and operates to rotate penetrator boring portion 38 to cause boring portion 38 to bore a tunnel T through ice layer L (FIG. 3).

As penetrator 34 works its way through ice layer L, the antenna elements 28 are retained in a generally vertical disposition by the wall of the tunnel T bored by the penetrator 34 (FIG. 3). The antenna elements 28 have to traverse water after leaving the body 10 and before entering the ice tunnel T. To prevent antenna elements 28 from swinging out, the flotation ring line 54, from body 10 to flotation ring 42, are short, so that by the time the elements 28 leave body 10, they are into the ice tunnel T.

Figure 4:
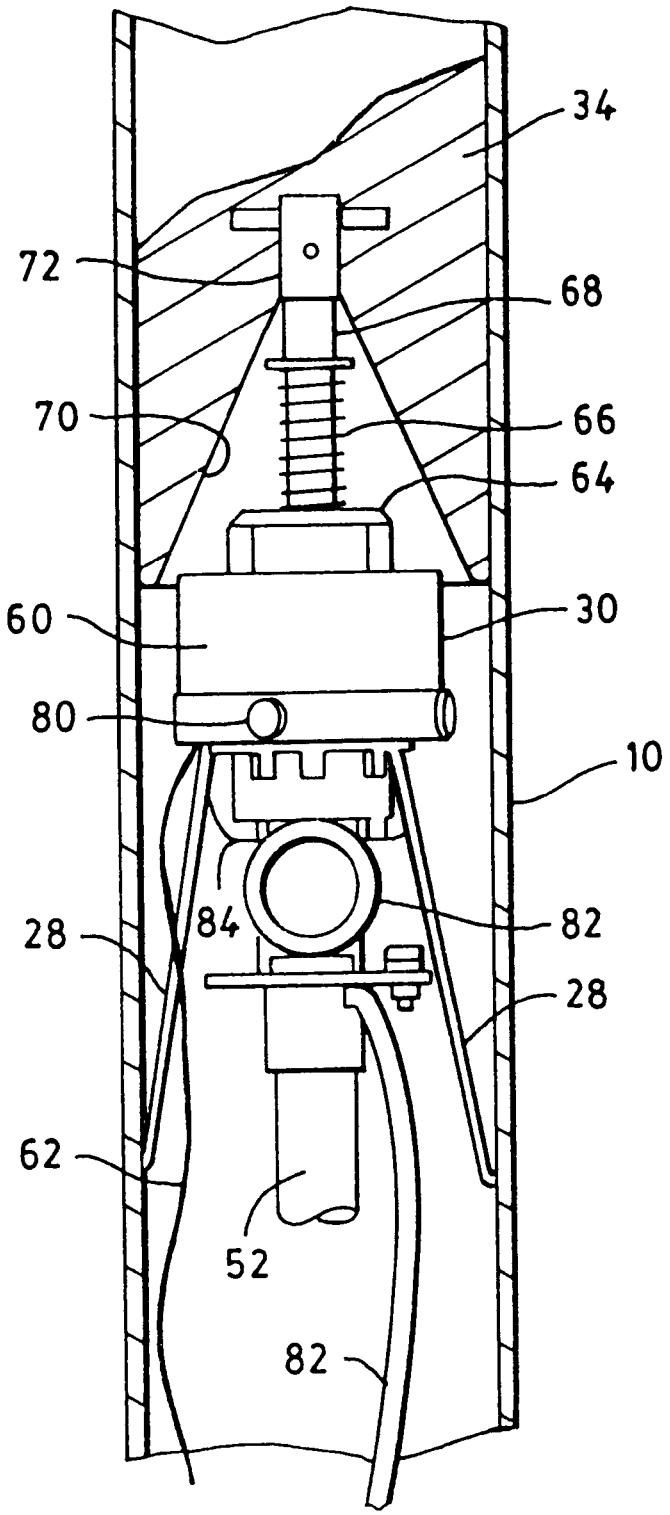
FIG. 4 is in part a side elevational view broken away, and in part a sectional view, showing components of the assembly in a non-employed configuration.
Figure 5:
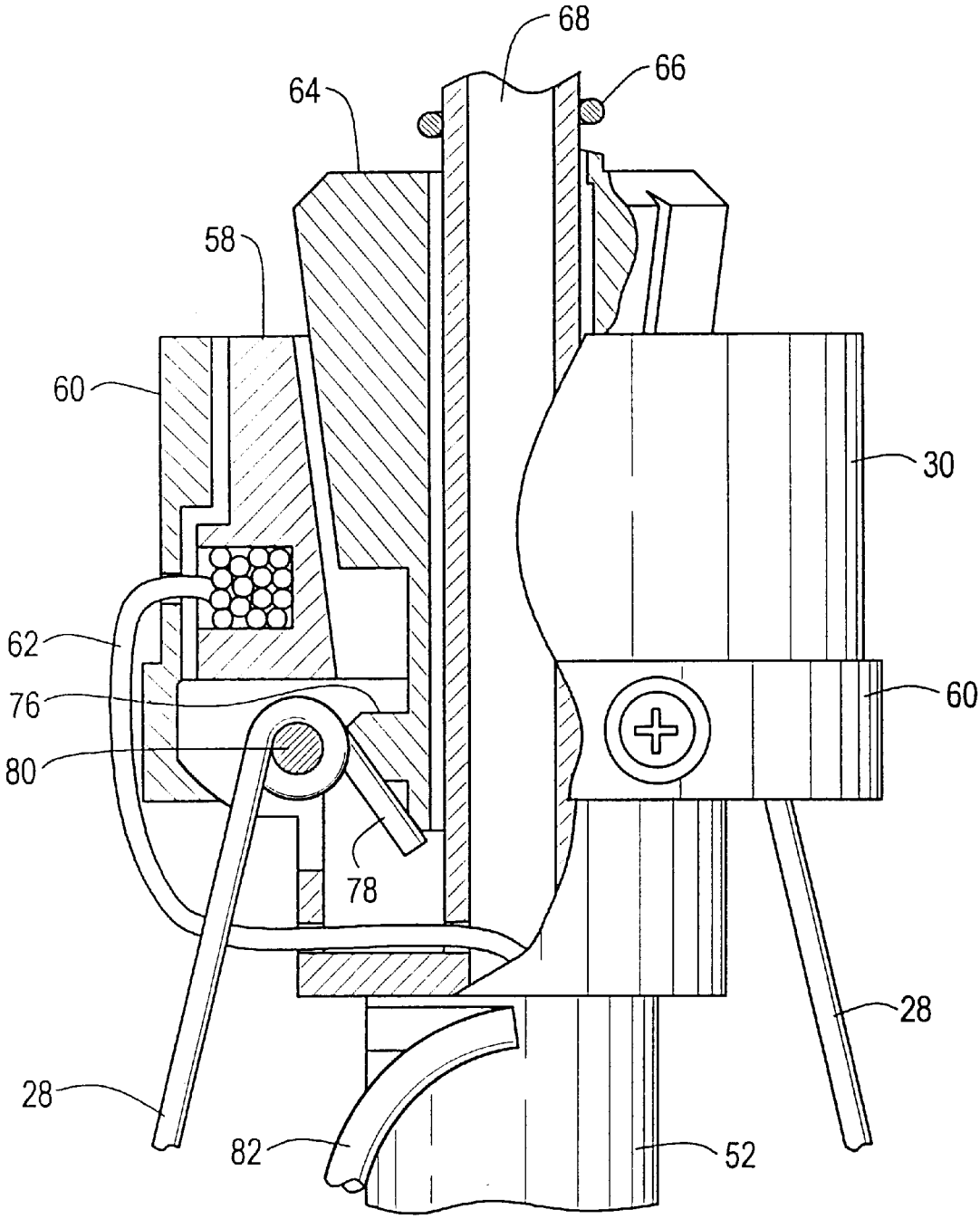
FIG. 5 is in part a side elevational view broken away, and in part a sectional view, showing components in a non-employed configuration.
Figure 8:
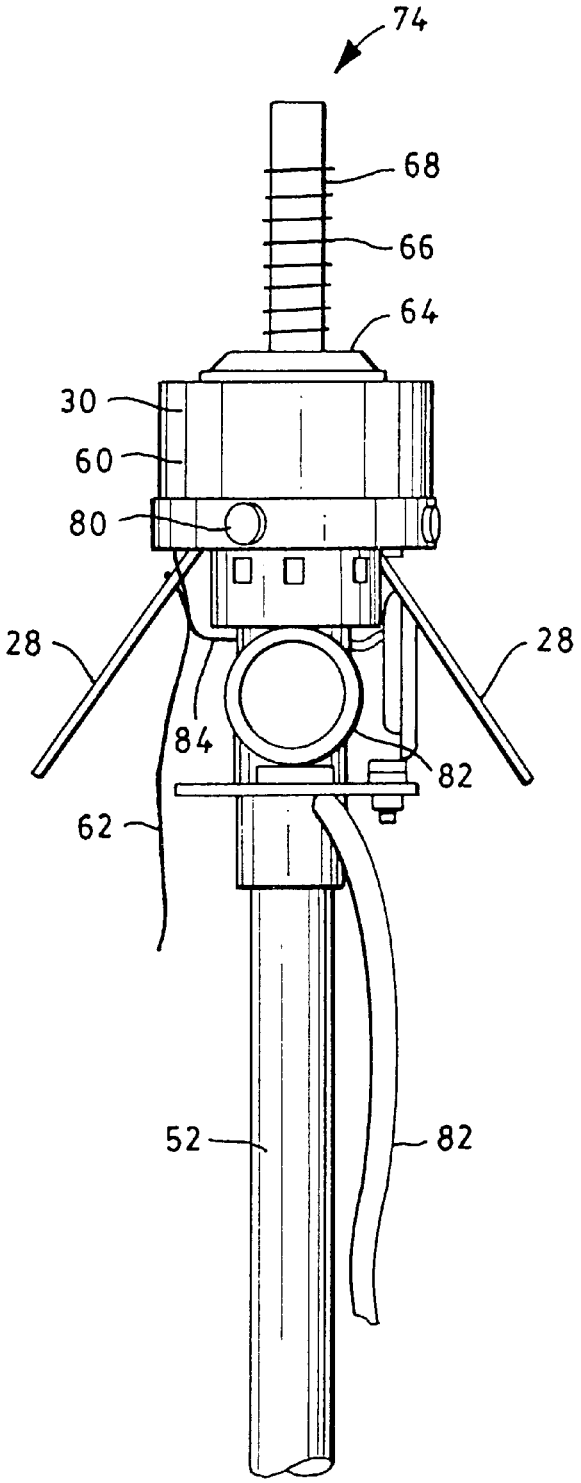
FIG. 8 is similar to FIG. 4, but shows components of FIG. 4 in a deployed configuration.

Referring to FIGS. 4 and 5, it will be seen that disposed in mast head portion 30 is a spool 58 within a spool housing 60 located below the penetrator 34. A tether 62 is wound on spool 58 and at one end is fixed to spool 58 and at the other end is fixed to bulkhead 20 (FIG. 1). As long as spool 58 revolves, mast 26 is free to extend. When spool 58 is stopped , tether 62 prevents further extension of mast 26. As shown in FIG. 5, spool 58 is free to revolve and pay out tether 62. A frusto-conically shaped clutch member 64 is disposed centrally of spool 58 and is biased downwardly by a coil spring 66 mounted on a post 68 extending into a pocket 70 (FIG. 4) in the after end of penetrator 34. Cast in the penetrator 34 is a sleeve 72 adapted to receive the free end 74 of post 68. Though biased downwardly by spring 66, clutch member 64 is unable to move downwardly because a flange portion 76 of clutch member 64 is engaged by antenna element tabs 78 (FIG. 5) which are not movable about pivot pin 80 so long as antenna elements 28 are in the ice tunnel T.

Figure 6:
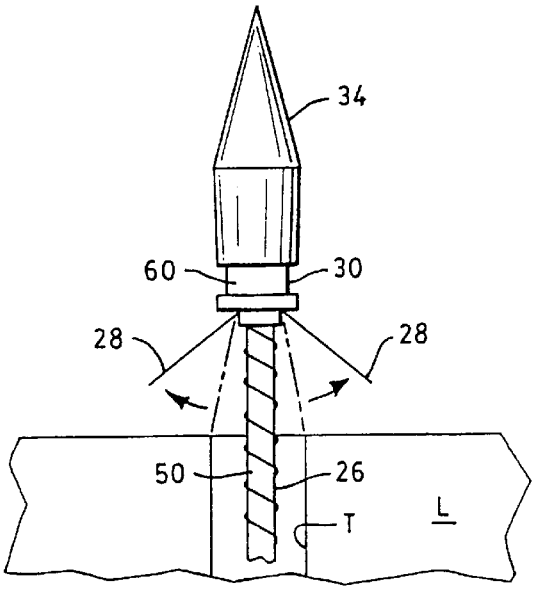
FIG. 6 is similar to FIG. 3, but shows the assembly emerging from an upper surface of the ice layer.
Figure 7:
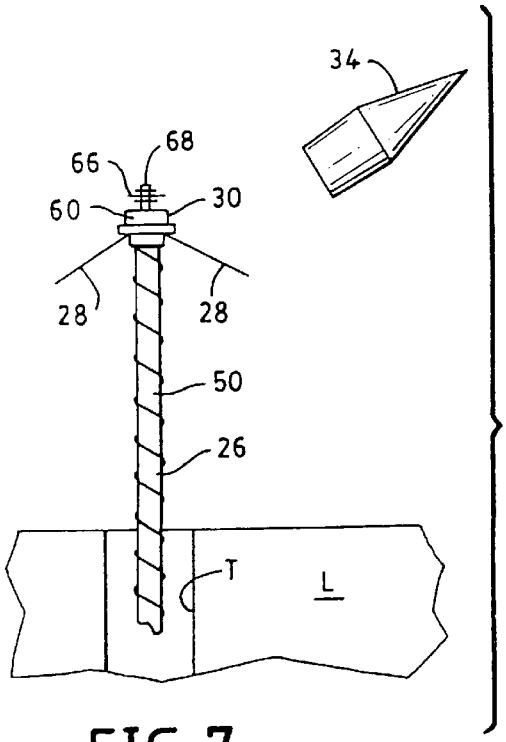
FIG. 7 is similar to FIG. 6, but shows the assembly further emerged from the upper surface of the ice layer.
Figure 9:
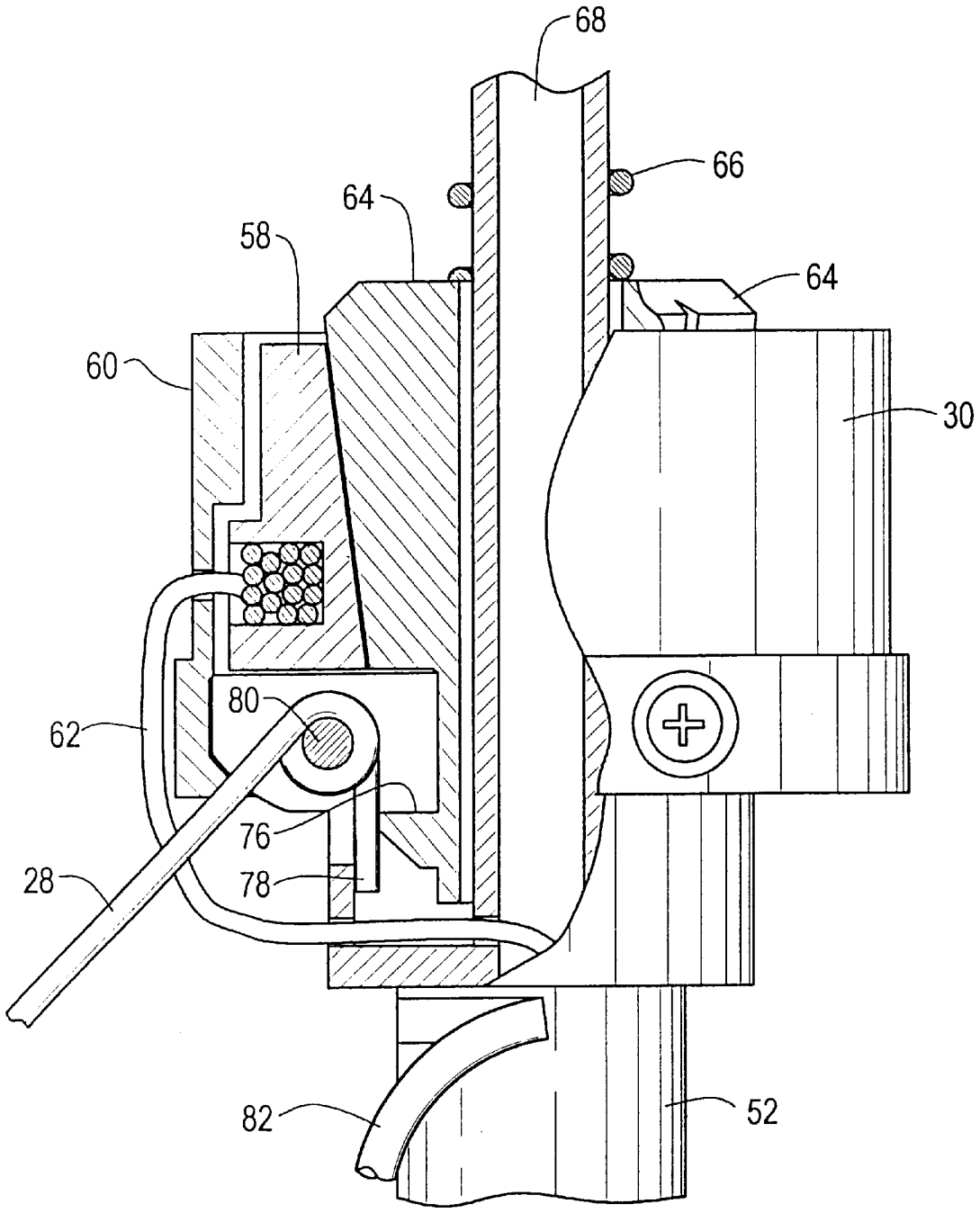
FIG. 9 is similar to FIG. 5, but shows components of FIG. 5 in a deployed configuration.

When breakthrough of penetrator 34 occurs (FIG. 6), antenna elements 28, are forced out by the clutch member 64 (FIG. 9) which is spring biased downwardly by coil spring 66. The coil spring 66 acts upwardly to eject the penetrator 34 (FIG. 7) from the remainder of the assembly, and acts downwardly to push the clutch member 64 into engagement with the interior of spool 58. The sleeve 72 fixed in the pocket 70 of penetrator 34 readily disengages from the free end 74 of post 68. The clutch member 64 can be pushed downwardly by spring 66 to engage spool 58 because once free of the confines of tunnel T, antenna elements 28 are free to pivot radially outwardly about pivot pins 80 in response to pressure on antenna element tabs 78 (FIG. 9). Movement of the clutch member 64 downwardly locks the antenna elements 28 into a radially extended position and resistant to wind loading. The clutch member 64 accordingly tightens down and stops spool 58, stopping paying out of tether 62, thereby stopping upward movement of the mast 26 at a pre-selected height above the surface of the ice.

Once mast 26 and antenna elements 28 are locked in place, the electronics assembly 23 in compartment 22 operate to unload a message by way of a cable 82 which is stowed wound around mast 26 (FIG. 2) and which interconnects the electronics of compartment 22 and the antenna elements 28 through electrically conductive wires 84.

A wire 86 (FIG. 1) may extend from the second end 18 of body 10 to place the electronics compartment 22 in communication with the submarine. If the wire 86 is used, outgoing messages may be transmitted from the submarine to the antenna assembly and need not be stored in the electronics assembly 23.

There is thus provided an antenna assembly for deployment through an ice layer, which assembly is compact and light, rugged and reliable, and in which there is no need for a spool rotation sensor, a microprocessor, an electromagnetic clutch, or an explosive squib. No electrical energy is consumed by the assembly with respect to deployment, conserving all power available for sending and receiving radio messages. Reliability is particularly enhanced inasmuch as breakthrough of the pentrator is directly sensed by mechanical movement of the antenna elements, rather than deduced from spool rotation readouts.

It is to be understood that the present invention is by no means limited to the particular construction herein disclosed and/or shown in the drawings, but also comprises any modifications or equivalents within the scope of the claims. For example, it has been found that a spring assist ordinarily is not required for ejection of the penetrator. The penetrator will eject from the post 68 by virtue of the upward momentum of the penetrator. Further, is some antenna element configurations it is preferable to mount lever elements (not shown) on the mast head, which lever elements are mounted in the same manner as the antenna elements described herein and operate in the same manner with respect to deployment of the assembly, but have no radio antenna function, that is, take no part in transmitting or receiving radio messages.

What is claimed is:

1. A submarine antenna assembly comprising:

a tubular body having a removable end cap at a first end thereof;

a mast stowable in said body and extendible therefrom upon release from confinement in said tubular body, said mast having elements pivotally mounted thereon, and said mast comprising a metal ribbon coil;

a penetrator stowable in said body and movable out of said body by said extendible mast upon removal of said end cap, said penetrator being adapted to bore through an ice layer;

an inflatable ring stowable in said body proximate said end cap and movable out of said body by said extendible mast upon the removal of said end cap;

first and second capsules in said body proximate said end cap for retaining and releasing gas, said first capsule being adapted upon opening thereof to pressurize said body to blow off said end cap to permit movement of said mast, said ring, and said penetrator out of said body, and said second capsule being adapted upon opening thereof to inflate said ring to hold said penetrator in engagement with an undersurface of said ice layer;

an electronic assembly disposed in said body and including message transmitting means in communication with said mast, and timer means in communication with said capsules;

a spool mounted in said mast and adapted for rotation;

a tether wound on said spool and fixed at a first end to said spool and fixed at a second end to said body; and clutch means engagable with said spool to stop rotation of said spool, whereby to stop paying out of said tether from said spool, said clutch means being activated by said penetrator breaking through said layer of ice.

2. The antenna assembly in accordance with claim 1 wherein said elements are antenna elements.

3. The antenna assembly in accordance with claim 2 wherein said clutch means is engageable with said antenna elements to force said antenna elements radially outwardly from said mast and to lock said antenna elements in a radially-extended attitude.

4. The antenna assembly in accordance with claim 2 wherein said spool comprises an annularly-shaped member.

5. The antenna assembly in accordance with claim 4 wherein said spool is mounted in a head portion of said mast.

6. The antenna assembly in accordance with claim 5 wherein said clutch means comprises a clutch member disposed in a central opening of said spool.

7. The antenna assembly in accordance with claim 6 wherein said clutch member comprises a frusto-conically shaped portion reciprocally moveable in said spool and engageable with a complementarily shaped inside wall of said spool.

8. The antenna assembly in accordance with claim 7 wherein said clutch member further comprises a flange portion engageable with said antenna elements to move said antenna elements pivotally to extend said antenna elements radially outwardly from said mast.

9. The antenna assembly in accordance with claim 8 wherein said clutch member is slidingly disposed on a post, and a spring is mounted on said post and biasing said clutch member toward said spool.

10. The antenna assembly in accordance with claim 9 wherein said penetrator is mounted on said post and said spring further biases said penetrator in a direction away from said post.

11. The antenna assembly in accordance with claim 1 wherein said penetrator comprises a pointed boring portion for boring through the ice layer, and a driving portion for driving said boring portion.

12. The antenna assembly in accordance with claim 1 wherein said inflatable ring, upon activation, is disposed around said mast, is attached to said body by a plurality of lines, and is adapted for disposition adjacent an undersurface of the ice layer, to hold said penetrator adjacent the ice layer undersurface.

13. The antenna assembly in accordance with claim 1 wherein said timer means is operative to open said first capsule to pressurize said body to blow off said end cap, and is operative to thereafter open said second capsule to inflate said ring.

14. A submarine antenna assembly comprising:

a tubular body having a removable end cap at a first end thereof;

a mast stowable in said body and extendible therefrom, said mast having elements pivotally mounted thereon;

a penetrator stowable in said body and movable out of said body by said extendible mast upon removal of said end cap, said penetrator being adapted to bore through an ice layer;

an inflatable ring stowable in said body proximate said end cap and movable out of said body by said extendible mast upon the removal of said end cap;

first and second capsules in said body proximate said end cap for retaining and releasing gas, said first capsule being adapted upon opening thereof to pressurize said body to blow off said end cap to permit movement of said mast, said ring, and said penetrator out of said body, and said second capsule being adapted upon opening thereof to inflate said ring to hold said penetrator in engagement with an undersurface of said ice layer;

an electronics assembly disposed in said body and including message transmitting means in communication with said mast, and timer means in communication with said capsules;

a spool mounted in said mast and adapted for rotation;

a tether wound on said spool and fixed at a first end to said spool and fixed at a second end to said body; and a frusto-conically shaped clutch means disposed centrally of said spool to stop rotation of said spool, whereby to stop paying out of said tether from said spool, said clutch means being activated by said penetrator breaking through said layer of ice, said clutch means being engageable with said antenna elements to force said antenna elements radially outwardly from said mast and to lock said antenna elements in a radially-extended attitude.

* * * * *